US006726046B2

(12) United States Patent
Orset

(10) Patent No.: US 6,726,046 B2
(45) Date of Patent: Apr. 27, 2004

(54) COLLAPSIBLE CONTAINER FOR TRANSPORT AND STORAGE

(75) Inventor: Olivier Orset, Meximieux (FR)

(73) Assignee: Arca Systems AB, Perstorp (SE)

( * ) Notice: Subject to any disclaimer, the term of this patent is extended or adjusted under 35 U.S.C. 154(b) by 0 days.

(21) Appl. No.: 10/204,357

(22) PCT Filed: Feb. 22, 2001

(86) PCT No.: PCT/SE01/00385

§ 371 (c)(1),
(2), (4) Date: Feb. 24, 2003

(87) PCT Pub. No.: WO01/62610

PCT Pub. Date: Aug. 30, 2001

(65) Prior Publication Data

US 2003/0164374 A1 Sep. 4, 2003

(30) Foreign Application Priority Data

Feb. 25, 2000 (SE) ..... 0000612

(51) Int. Cl.[7] ..... B65D 6/18
(52) U.S. Cl. ..... 220/7; 220/1.5
(58) Field of Search ..... 220/7, 6, 1.5

(56) References Cited

U.S. PATENT DOCUMENTS 3,638,586 A 2/1972 Elshout
4,674,647 A 6/1987 Gyenge et al.

FOREIGN PATENT DOCUMENTS

| | | |
|---|---|---|
| DE | 9203114 | 7/1992 |
| JP | 9309529 | 12/1997 |
| WO | 0002787 | 2/2000 |

*Primary Examiner*—Stephen Castellano
(74) *Attorney, Agent, or Firm*—Stevens, Davis, Miller & Mosher, L.L.P.

(57) ABSTRACT

Collapsible container (1) for transport and storage, which container includes a carrying base part (20), collapsible side walls (30). The side walls (30) are moveably attached to the base part (20). Adjacent side walls (30) are interconnectable. At least two long side walls ($\mathbf{30}^{I}$ and $\mathbf{30}^{II}$) each are provided with a first and a second horizontal folding line (31 and 32 respectively) by being provided with hinges (3). The first horizontal folding line (31) constitutes the lower end (33) of the side wall (30) at which the side wall (30) connects with the base part (20). The second horizontal folding line (32), which divides the side wall (30) into an upper side wall part ($\mathbf{30}_{U}$) and a lower side wall part ($\mathbf{30}_{L}$), is placed at a distance from the first horizontal folding line (31), between the lower end (33) and upper rim (34) of the side walls (30). The two horizontal folding lines (31 and 32 respectively) are mainly parallel.

14 Claims, 2 Drawing Sheets

COLLAPSIBLE CONTAINER FOR TRANSPORT AND STORAGE

Figure 1:
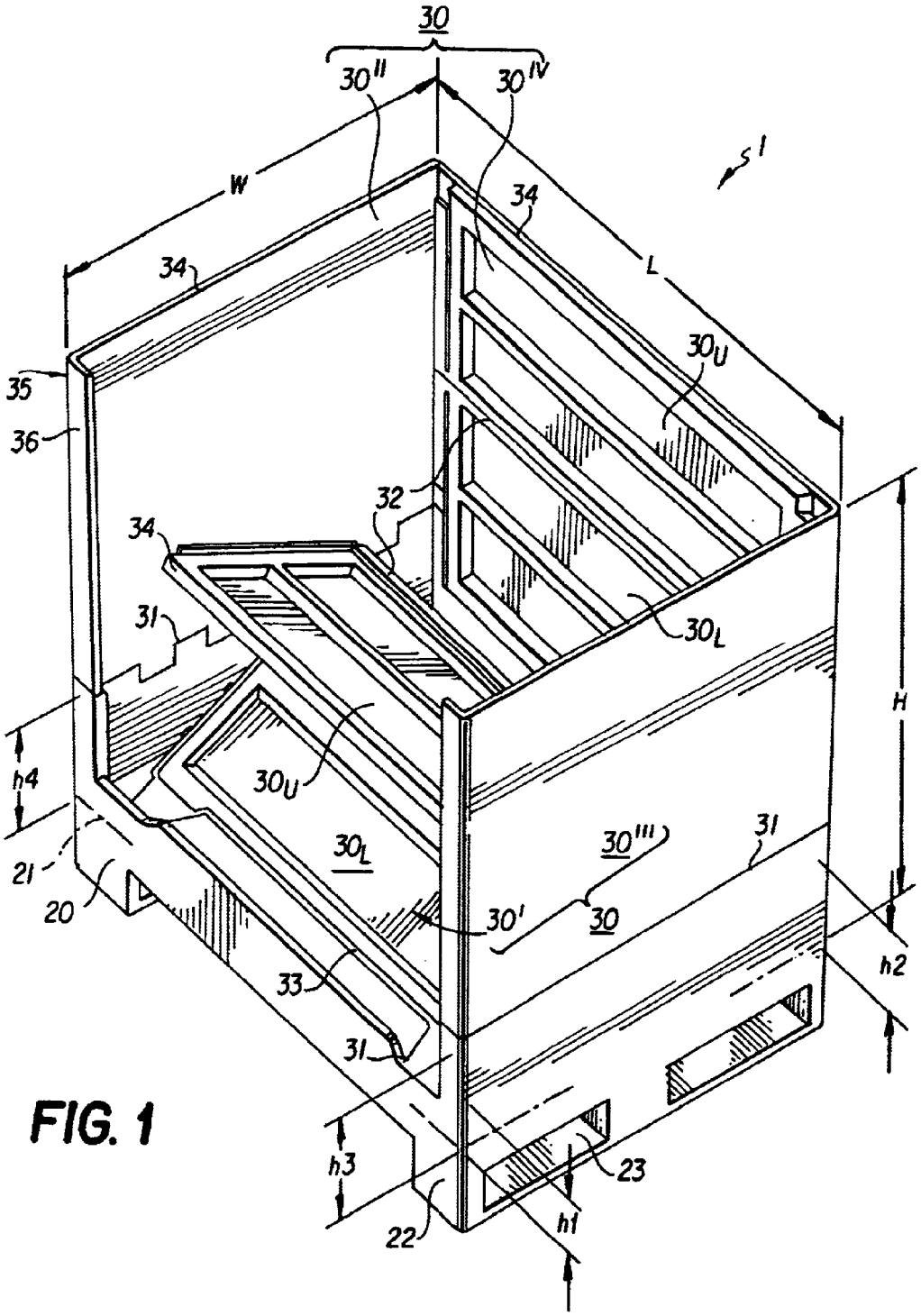

The present invention relates to collapsible container such as a collapsible pallet container for transport and storage.

Collapsible containers of the foldable pallet container type, are rather popular since they will make a radical saving of the empty return transport volume possible. Foldable pallet containers are advantageously made of thermoplastic materials which will give light and still sturdy containers which are easy to keep clean. Another advantage is that the tare-weight of such containers is very stable which is not the case with, for example, wood containers where the tare-weight can double when the wood becomes wet. Yet another advantage is that thermoplastic materials do not corrode, which is the case with containers made from metal such as steel and aluminium. Most thermoplastic materials furthermore have a good resistance to chemical substances such as acids and bases, which is not the case with most metals.

Most collapsible containers available suffer from the disadvantage that the usable internal height is limited by the width of the container since the foldable part of the side walls, of practical reasons, needs to be kept within the base dimensions when folded. It is therefore necessary to design containers with large base dimensions when larger heights are required. It is sometimes desirable to have containers with smaller base dimensions and larger height due to handling in small spaces.

It has, through the present invention, been made possible to solve the above mentioned problem, wherein a collapsible container with a new height to width ratio has been achieved. The invention relates to a collapsible container, preferably a collapsible pallet container for transport and storage, which collapsible container includes a carrying base part with a width W and a length L. It further includes collapsible side walls, which are constituted by short side walls and long side walls. The side walls are moveably attached to the base part. Adjacent side walls are interconnectable. The invention is characterised in that, at least the two long side walls each are provided with a first and a second horizontal folding line by being provided with hinges. The first horizontal folding line constitutes a lower end of the side wall at which the side wall connects with the base part. The second horizontal folding line, which divides the side wall into an upper side wall part and a lower side wall part, is placed at a distance from the first horizontal folding line, between the lower end and an upper rim of the side walls. The two horizontal folding lines are mainly parallel. The long side walls extends to a height H above a load surface of the base part when erected. The height H is preferably larger than the width W. The lower side wall part is preferably larger than, or mainly as large as, the upper side wall part.

According to one embodiment of the invention the two short side walls are provided with uninterrupted rigid sections extending from the lower end to the upper rim, reaching the height H above the load surface when erected. The rigid sections are possibly provided with a flange intended to guide and join with the vertical edge of the adjacent side wall when erected.

The first horizontal folding lines of the long side walls are preferably arranged on a height h1 and h2 respectively, above the load surface while the first and only horizontal folding lines of the short side walls are arranged on a height h3 and h4 respectively, above the load surface, whereby h1<h2 and h2<h3 and h3<h4 so that the short side walls are folded over the long side walls. The first and/or the second horizontal folding lines are possibly constituted by so called live hinges. According to a preferred alternative the first and/or the second horizontal folding lines are constituted by hinges made of at least two parts which two parts each possibly constitutes an integrated part of the base part, a short side wall, an upper side wall part or a lower side wall part while possible additional parts constitutes intermediate parts arranged between the two parts. It is of course possible that the first or the second horizontal folding lines are constituted by a so called live hinge.

It is, according to one embodiment of the invention, advantageous to arrange the first horizontal folding lines of the long side walls so that they can be displaced vertically between a height h1' and h1", and a height h2' and h2" respectively, above the load surface. The first and only horizontal folding lines of the short side walls are arranged on a height h3 and h4 respectively, above the load surface. As in the embodiment above, h1'<h2 and h2'<h3 and h3<h4, wherein the short side walls are folded over the long side walls.

The vertical edges of the long side walls are preferably provided with gripping means intended to engage corresponding means, placed on the flanges of the short side walls. The gripping means engages the corresponding means by a vertical movement downwards so that the long side walls becomes mechanically locked to the short side walls, preventing the long side walls from folding inwards, unless lifted upwards.

The base part preferably has the basic shape of a pallet provided with feet and skids making it possible to handle the container with mechanical means such as a fork lift.

The collapsible container is preferably manufactured through injection moulding, vacuum moulding, blow moulding or press moulding of one or more polymeric materials such as polyethylene, polypropylene, polybutene, polyvinylchloride, polyalkylene-therephtalate, acrylonitrile-butadiene-styrene copolymer, polyamide, polycarbonate or the like. Since the desired material characteristics of the different parts that the container is made up of can vary from part to part it is possible to add different additives to the thermoplastic material that will make this possible. As examples of such known additives can be mentioned ethylene-vinyl-acetate and rubber beads which will make the material more ductile and more impact resistant, but on the other hand more disposed to thermal creepage, or glass fibre, carbon fibre, steel fibre or aramide fibre which will make the material more rigid, less disposed to thermal creepage but on the other hand more brittle.

The invention is illustrated further through the enclosed figures showing embodiments of the invention whereby, FIG. 1 shows, in perspective view, an embodiment of a collapsible container 1 according the invention.

Figure 2:
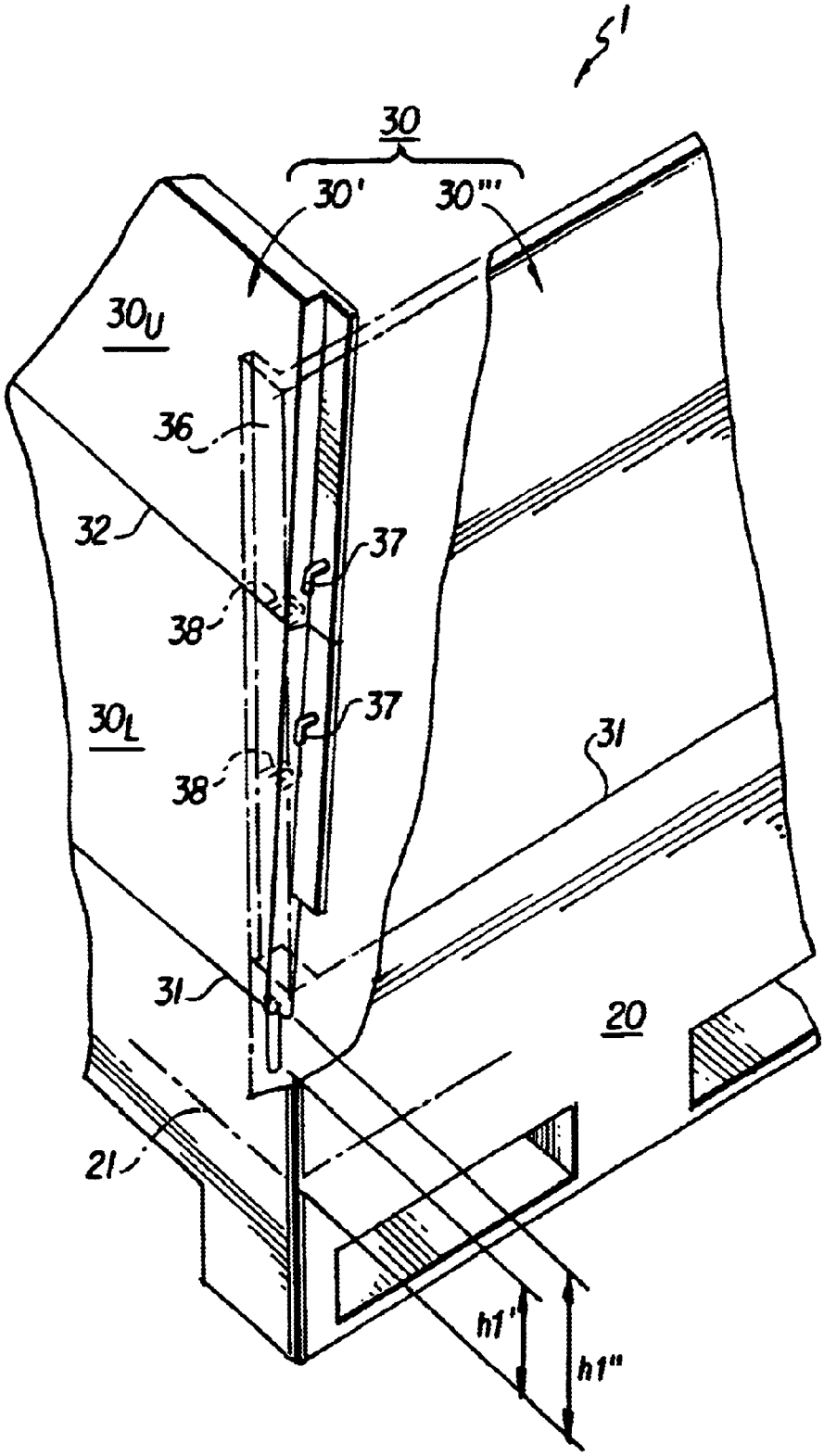

FIG. 2 shows, in perspective view, the part of a collapsible container 1 according the invention, where a long side wall $\mathbf{30}^{I}$ connects with a short side wall $\mathbf{30}^{III}$.

FIG. 1 shows, in perspective view, a collapsible container 1 in the form of a collapsible pallet container. The collapsible container 1 is intended for transport and storage. The collapsible container 1 includes a carrying base part 20 with a width W and a length L, collapsible side walls 30 which are constituted by short side walls $\mathbf{30}^{III}$ and $\mathbf{30}^{IV}$ respectively, and long side walls $\mathbf{30}^{I}$ and $\mathbf{30}^{II}$ respectively. The side walls 30 are moveably attached to the base part 20. The two long side walls $\mathbf{30}^{I}$ and $\mathbf{30}^{II}$ are each provided with a first and a second horizontal folding line 31 and 32 respectively by being provided with hinges 3. The first horizontal folding line 31 constitutes the lower end 33 of the side wall 30, at which the side wall 30 connects with the base part 20. The second horizontal folding lines 32, which divides the long side walls $\mathbf{30}^{I}$ and $\mathbf{30}^{II}$ into an upper side wall part $\mathbf{30}_{U}$ and a lower side wall part $\mathbf{30}_{L}$, is placed at a distance from the first horizontal folding line 31, between the lower end 33 and upper rim 34 of the side walls 30. The two horizontal folding lines 31 and 32 respectively are mainly parallel. The long side walls $\mathbf{30}^{I}$ and $\mathbf{30}^{II}$ respectively extends to a height H above a load surface 21 of the base part 20 when erected. The height H is larger than the width W. The lower side wall part $\mathbf{30}_{L}$ is furthermore mainly as large as the upper side wall part $\mathbf{30}_{U}$.

The two short side walls $\mathbf{30}^{III}$ and $\mathbf{30}^{IV}$ respectively are provided with uninterrupted rigid sections 35 extending from the lower end 33 the upper rim 34, reaching the height H above the load surface 21 when erected. The rigid sections 35 are provided with a flange 36 intended to guide and join with the vertical edge of the adjacent side wall 30 when erected making the adjacent side walls 30 inter-connectable. The side walls 30 are attached to the base 20 so that the first horizontal folding lines 31, of the long side walls $\mathbf{30}^{I}$ and $\mathbf{30}^{II}$ respectively are arranged on a height h1 and h2 respectively, above the load surface 21. The first and only horizontal folding lines $\mathbf{31}^{III}$ and $\mathbf{31}^{IV}$ respectively, of the short side walls $\mathbf{30}^{III}$ and $\mathbf{30}^{IV}$ respectively, are arranged on a height h3 and h4 respectively, above the load surface 21, whereby h1<h2 and h2<h3 and h3<h4. The short side walls $\mathbf{30}^{III}$ and $\mathbf{30}^{IV}$ respectively, are hereby folded over the long side walls $\mathbf{30}^{I}$ and $\mathbf{30}^{II}$ respectively.

The first and the second horizontal folding lines 31 and 32 respectively are constituted by hinges made of two main parts which two main parts each constitutes an integrated part of the base part 20, a short side wall $\mathbf{30}^{III}$ and $\mathbf{30}^{IV}$ respectively, an upper side wall part $\mathbf{30}_{U}$ and a lower side wall part $\mathbf{30}^{L}$. Additional parts constitutes intermediate and joining parts arranged between the two parts. The first and/or the second horizontal folding lines 31 and 32 respectively may alternatively be constituted by so called live hinges.

The base part 20 has the basic shape of a pallet provided with feet 22 and skids 23 which makes it possible to handle the container 1 with mechanical means such as a fork lift.

According to one embodiment of the invention the feet of the base part is provided with means for holding wheels. Wheels are suitably attached to the lower part of the feet at each corner of the base part. At least two of the wheels are castor type wheels. In order to achieve flexibility the wheels are suitably easily dismountable.

A collapsible container 1 according to the invention is advantageously manufactured through injection moulding, vacuum moulding, blow moulding or press moulding of one or more polymeric materials such as polyethylene, polypropylene, polybutene, polyvinylchloride, polyalkylene-therephtalate, acrylonitrile-butadiene-styrene copolymer, polyamide, polycarbonate or the like.

FIG. 2 shows, in perspective view, the part of a collapsible container 1 according the invention, where a long side wall $\mathbf{30}^{I}$ connects with a base part 20. Parts of the collapsible container 1 have been made translucent in order to facilitate understanding of the invention. The side walls 30 are moveably attached to the base part 20. The two long side walls $\mathbf{30}^{I}$ and $\mathbf{30}^{II}$ (see FIG. 1) are each provided with a first and a second horizontal folding line 31 and 32 respectively by being provided with hinges 3. The first horizontal folding line 31 constitutes the lower end 33 (see FIG. 1) of the side wall 30, at which the side wall 30 connects with the base part 20. The second horizontal folding lines 32, which divides the long side walls $\mathbf{30}^{I}$ and $\mathbf{30}^{II}$ into an upper side wall part $\mathbf{30}_{U}$ and a lower side wall part $\mathbf{30}_{L}$, is placed at a distance from the first horizontal folding line 31, between the lower end 33 and upper rim 34 (see FIG. 1) of the side walls 30. The two horizontal folding lines 31 and 32 respectively are mainly parallel. The long side walls $\mathbf{30}^{I}$ and $\mathbf{30}^{II}$ respectively extends to a height H (see FIG. 1) above a load surface 21 of the base part 20 when erected. The height H (see FIG. 1) is larger than the width W (see FIG. 1). The first horizontal folding lines $\mathbf{31}^{I}$ and $\mathbf{31}^{II}$ respectively of the long side walls $\mathbf{30}^{I}$ and $\mathbf{30}^{II}$ respectively are arranged so that they can be displaced vertically between a height h1' and h1", and a height h2' and h2" (not shown) respectively, above the load surface 21. The first and only horizontal folding lines $\mathbf{31}^{III}$ (see FIG. 1) and $\mathbf{31}^{VI}$ (see FIG. 1) respectively of the short side walls $\mathbf{30}^{III}$ and $\mathbf{30}^{IV}$ (see FIG. 1) respectively are arranged on a height h3 (see FIG. 1) and h4 (see FIG. 1) respectively, above the load surface 21. As in the embodiment described in connection to FIG. 1, h1'<h2 and h2'<h3 and h3<h4 so that the short side walls $\mathbf{30}^{III}$ and $\mathbf{30}^{IV}$ respectively are folded over the long side walls $\mathbf{30}^{I}$ and $\mathbf{30}^{II}$ respectively (see FIG. 1).

The first and the second horizontal folding lines 31 and 32 respectively are constituted by hinges made of two main parts which two main parts each constitutes an integrated part of the base part 20, a short side wall $\mathbf{30}^{III}$ and $\mathbf{30}^{IV}$ respectively, an upper side wall part $\mathbf{30}_{U}$ and a lower side wall part $\mathbf{30}_{L}$.

The two short side walls $\mathbf{30}^{III}$ and $\mathbf{30}^{IV}$ respectively are provided with uninterrupted rigid sections 35 extending from the lower end 33 the upper rim 34 (see FIG. 1), reaching the height H (see FIG. 1) above the load surface 21 when erected. The rigid sections 35 are provided with a flange 36 intended to guide and join with the vertical edge of the adjacent side wall 30 when erected making the adjacent side walls 30 inter-connectable.

The vertical edges of the long side walls $\mathbf{30}^{I}$ and $\mathbf{30}^{II}$ respectively are provided with gripping means 37 to engage corresponding means 38, placed on the flanges 36 the short side walls $\mathbf{30}^{III}$ and $\mathbf{30}^{IV}$ respectively. The long side walls $\mathbf{30}^{I}$ and $\mathbf{30}^{II}$ respectively, will hereby become mechanically locked to the short side walls $\mathbf{30}^{III}$ and $\mathbf{30}^{VI}$ respectively by a vertical movement downwards, preventing the long side walls $\mathbf{30}^{I}$ and $\mathbf{30}^{II}$ respectively from folding inwards, unless lifted upwards.

The invention is not limited by the embodiments shown since they can be altered in different ways within the scope of the invention. It is for example possible to provide all four side walls 30 with both a fist and a second folding line 31 and 32 respectively. It is then advantageous to arrange the second, upper folding lines 32 on different heights between adjacent side walls 30.

What is claimed is:

1. A collapsible pallet container (1) for transport and storage, which collapsible container (1) includes a carrying base part (2) with a width (W) and a length (L), collapsible side walls (30) which are constituted by short side walls ($\mathbf{30}^{III}$ and $\mathbf{30}^{IV}$ respectively) and long side walls ($\mathbf{30}^{I}$ and $\mathbf{30}^{II}$ respectively), whereby the side walls (30) are moveably attached to the base part (20) and that adjacent side walls (30) are inter-connectable, that at least the two long side walls ($\mathbf{30}^{I}$ and $\mathbf{30}^{II}$) each are provided with a first and a second horizontal folding line (31 and 32 respectively) by being provided with hinges (3), which first horizontal folding line (31) constitutes a lower end (33) of the side wall (30) at which the side wall (30) connects with the base part (20) and which second horizontal folding line (32), which divides the side wall (30) into an upper side wall part ($30_U$) and a lower side wall part ($30_L$, is placed at a distance from the first horizontal folding line (31), between the lower end (33) and an upper rim (34) of the side walls (30) and that the two horizontal folding lines (31 and 32 respectively) are mainly parallel, wherein the first horizontal folding lines ($31^I$ and $31^{II}$ respectively) of the long side walls ($30^I$ and $30^{II}$ respectively) are arranged so that they can be displaced vertically between a height h1' and h1", and a height h2' and h2" respectively, above the load surface (21) while the first and only horizontal folding lines ($31^{III}$ and $31^{IV}$ respectively) of the short side walls ($30^{III}$ and $30^{IV}$ respectively) are arranged on a height h3 and h4 respectively, above the load surface (21), whereby h1'<h2 and h2'<h3 and h3<h4 so that the short side walls ($30^{III}$ and $30^{IV}$ respectively) are folded over the long side walls ($30^I$ and $30^{II}$ respectively), that the vertical edges of the long side walls ($30^I$ and $30^{II}$ respectively) are provided with gripping means (37) intended to engage corresponding means (38), placed on the flanges (36) of the short side walls ($30^{III}$ and $30^{IV}$ respectively) becomes mechanically locked to the short side walls ($30^{III}$ and $30^{IV}$ respectively), preventing the long side walls ($30^I$ and $30^{II}$ respectively) from folding inwards, unless lifted upwards.

2. A collapsible container (1) according to claim 1, wherein the long side walls ($30^I$ and $30^{II}$ respectively) extends to a height (H) above a load surface (21) of the base part (20) when erected and that the height (H) is larger than the width (W).

3. A collapsible pallet container (1) according to claim 1, wherein the lower side wall part ($30_L$) is larger than, or mainly as large as, the upper side wall part ($30_U$).

4. A collapsible pallet container (1) according to claim 2, wherein the two short side walls ($30^{III}$ and $30^{IV}$ respectively) are provided with uninterrupted rigid sections (35) extending from the lower end (33) to the upper rim (34), reaching the height (H) above the load surface (21) when erected.

5. A collapsible container (1) according to claim 4, wherein the rigid sections (35) are provided with a flange (36) intended to guide and join with the vertical edge of the adjacent side wall (30) when erected.

6. A collapsible pallet container (1) according to claim 4,wherein the first horizontal folding lines ($31^I$ and $31^{II}$ respectively) of the long side walls ($30^I$ and $30^{II}$ respectively) are arranged on a height h1 and h2 respectively, above the load surface (21) while the first and only horizontal folding lines ($31^{III}$ and $31^{IV}$ respectively) of the short side walls ($30^{III}$ and $30^{IV}$ respectively) are arranged on a heigh h3 and h4 respectively, above the load surface (21), whereby h1<h2 and h2<h3 and h3<h4 so that the short side walls ($30^{III}$ and $30^{VI}$ respectively) are folded over the long side walls ($30^I$ and $30^{II}$ respectively).

7. A collapsible pallet container (1) according to claim 1, wherein the first and/or the second horizontal folding lines (31 and 32 respectively) are constituted by so called live hinges.

8. A collapsible pallet container (1) according to claim 1, wherein the first and/or the second horizontal folding lines (31 and 32 respectively) are constituted by hinges made of at least two parts which two parts each possibly constitutes an integrated part of the base part (20) a short side wall ($30^{III}$ and $30^{IV}$ respectively) an upper side all part ($30_U$) or a lower side wall part ($30_L$) while possible additional parts constitutes intermediate parts arranged between the two parts.

9. A collapsible pallet container (1) according to claim 8, wherein the first or the second horizontal folding lines (31 and 32 respectively) are constituted by a so called live hinge.

10. A collapsible pallet container (1) according to claim 1, wherein the base part (20) has the basic shape of a pallet provided with feet (22) and skids (23) making it possible to handle the container (1) with mechanical means such as a fork lift.

11. A collapsible container (1) according to claim 10, wherein the feet (22) of the base part (20) is provided with means for holding wheels.

12. A collapsible container (1) according to claim 10, wherein wheels are attached to the lower part of the feet (22) at each corner of the base part (20), that at least two of the wheels are castor type wheels.

13. A collapsible pallet container according to claim 10, wherein the wheels are easily dismountable.

14. A collapsible pallet container 91) according to claim 1, wherein the collapsible (1) is manufactured through injection molding, vacuum molding, blow molding or press molding of one or more polymeric materials such as polyethylene, polypropylene, polybutene, polyvinylchloride, polyalkylene-therephtalate, acrylonitrile-butadiene-styrene copolymer, polyamide, polycarbonate or the like.

* * * * *